United States Patent [19]

Kamimura

[11] Patent Number: 4,738,185

[45] Date of Patent: Apr. 19, 1988

[54] SWASH PLATE-TYPE PUMP-MOTOR

[75] Inventor: Toshio Kamimura, Fuwa, Japan

[73] Assignee: Teijin Seiki Company Limited, Osaka, Japan

[21] Appl. No.: 886,264

[22] Filed: Jul. 16, 1986

[30] Foreign Application Priority Data

Aug. 9, 1985 [JP] Japan ..... 60-175424

[51] Int. Cl.[4] ..... F01B 13/04

[52] U.S. Cl. ..... 91/507; 91/503; 92/57

[58] Field of Search ..... 91/507, 503, 499; 92/57

[56] References Cited

U.S. PATENT DOCUMENTS

| | | | |
|---|---|---|---|
| Re. 24,048 | 8/1955 | Wright | 92/57 X |
| 2,161,143 | 6/1939 | Doe et al. | 91/507 |
| 2,737,899 | 3/1956 | Bonnette et al. | 91/503 X |
| 3,079,869 | 3/1963 | Purcell | 91/507 X |
| 3,678,804 | 7/1972 | Heyl | 91/507 |
| 3,823,557 | 7/1974 | Van Wagenen et al. | 91/499 X |

FOREIGN PATENT DOCUMENTS

| | | | |
|---|---|---|---|
| 49-92438 | 12/1972 | Japan | 91/503 |
| 48-12883 | 4/1973 | Japan | 91/507 |
| 313972 | 5/1930 | United Kingdom | 91/507 |
| 532635 | 1/1941 | United Kingdom | 91/503 |

OTHER PUBLICATIONS

MacDuff, Abstract of Ser. No. 717,764, Pub. 10-3-1-1950, 639 O.G. 1661.

*Primary Examiner*—Carlton R. Croyle
*Assistant Examiner*—Paul F. Neils
*Attorney, Agent, or Firm*—Cushman, Darby & Cushman

[57] ABSTRACT

A swash plate plunger type pump-motor comprises a casing, a rotatable cylinder block formed with chambers, a plurality of plungers axially slideably received in the chambers, rotatable swash plate rotatably supported through a bearing within the casing, a plunger retainer adapted to prevent the plungers from disengaging from the swash plate, and a rotational shaft on which the cylinder block is fixedly mounted. The plunger retainer and the swash plate are connected with each other in such a manner that the front faces of the plunger head portions contact the swash plate and that the rear faces of the plunger head portions contact the plunger retainer. The rotational axis of the swash plate is inclined at a predetermined angle with respect to the rotational axis of the rotational shaft.

2 Claims, 4 Drawing Sheets

SWASH PLATE-TYPE PUMP-MOTOR

FIELD OF THE INVENTION

The present invention relates in general to hydraulic power transmission and in particular to a plunger pump or motor of the swash plate plunger type.

SUMMARY OF THE INVENTION

In accordance with the important aspect of the present invention, there is provided an axial-cylinder type pump-motor comprising a casing formed with inlet and outlet ports, a rotatable cylinder block rotatably supported within the casing and formed with a plurality of axially extending chambers, a plurality of plungers axially slideably received in the chambers and each formed with a plunger head portion having a front face, a rear face and an intermediate face between the front and rear faces, a rotatable swash plate rotatably supported through a bearing within the casing and having a rotational axis, a plunger retainer adapted to prevent the plungers from disengaging from the swash plate, the plunger retainer and the swash plate being connected with each other in such a manner that the front faces of the plunger head portions contact the swash plate and that the rear faces of the plunger head portions contact the plunger retainer, and a rotational shaft having a rotational axis passing through the swash plate and through the plunger retainer, the cylinder block being fixedly mounted on the rotational shaft and the rotational axis of the swash plate being inclined at a predetermined angle with respect to the rotational axis of the rotational shaft.

DESCRIPTION OF THE PRIOR ART

In aircraft, actuation of control surfaces, for example, ailerons, flaps, is performed by a hydraulic power control system 100 as shown in FIG. 7. The hydraulic system 100 includes an electric motor 102 to which an input signal 101 is inputted, a hydraulic pump 104 connected to the electric motor 102, and an actuator 106 for driving a flap 108. In the hydraulic system 100, high-pressure oil is admitted from a high-pressure creating source 110 to the hydraulic pump 104, inlet and outlet ports 112 and 113 of the hydraulic pump 104 are directly connected to the actuator 106 without interposition of valve change-over means, and an output signal 118 of the actuator 106 is fed back to the input signal 101 of the electric motor 102 in order to control movement of a piston 120 of the actuator 106. As a swash plate plunger pump which is used in such a hydraulic power control system for aircraft, for instance, there is shown in Japanese Provisional Publication No. 48-12883, a hydraulic pump of the type wherein the piston shoe, to which the power input is connected, drives the axial pistons, and the spherical head portions of the axial pistons are retained in the spherical-shaped cavities formed in the piston shoe which slides along and on the fixed swash plate fixedly supported within the pump casing. As an swash plate plunger motor, there is shown in Japanese Laid-open Publication No. 49-92438 which is assigned to the assignee of the present invention, a hydraulic motor of the type wherein the rotatable swash plate, to which the power output is connected, is driven by the plungers, and the rotatable swash plate is rotatably supported through the thrust bearing on the fixed swash plate fixedly mounted within the motor casing.

However, in the hydraulic pump disclosed by the former publication, it is required to forcibly lubricate the spherical head portions of the axial pistons, which are retained in the spherical-shaped cavities formed in the piston shoe, by admitting high-pressure oil in the spherical-shaped cavities in order to prevent wear on the sliding surfaces. In consequence, there is the drawback that leakage of oil increases and thus the hydraulic pump 104 incorporated in the hydraulic system as shown in FIG. 7 has to be rotated even during stop of the actuator 106 to compensate the oil leakage. In the hydraulic motor disclosed by the latter publication, although the aforementioned drawback in the former prior art rarely occurs, there is the drawback that the internal pressure of the casing causes the plungers in stroke of suction to move toward the opposite direction if it becomes high pressure. The suction and compression operation cannot therefore be accurately performed as desired.

Accordingly, the object of the present invention is to provide an improved swash plate plunger type pump-motor which can eliminate and prevent the drawbacks inevitably inherent in the prior art axial-cylinder type pump-motor.

BRIEF DESCRIPTION OF THE DRAWINGS

The drawbacks of a prior art swash plate plunger type pump-motor and the features and advantages of an improved swash plate plunger type pump-motor according to the present invention will be more clearly understood from a consideration of the following detailed description taken in conjunction with the accompanying drawings in which.

DESCRIPTION OF THE PREFERRED EMBODIMENTS

Figure 1:
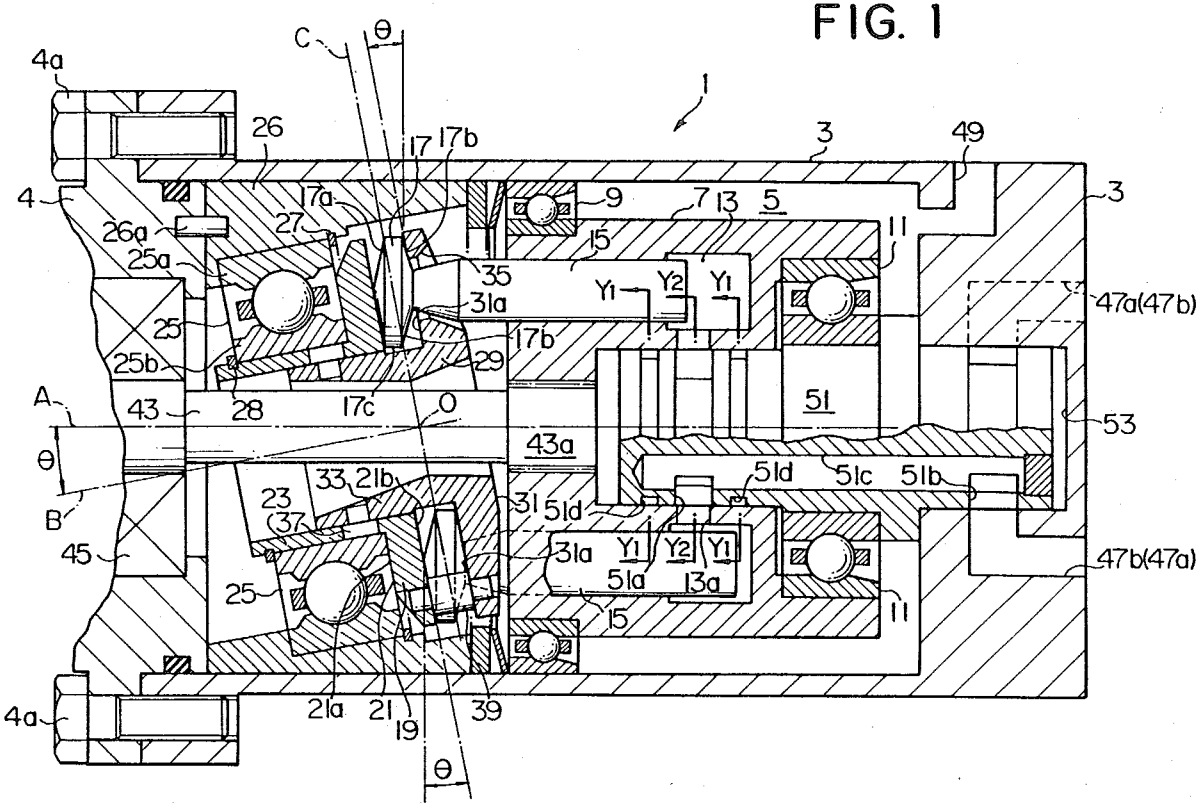
FIG. 1 is a longitudinal sectional view showing the swash plate plunger type pump-motor constructed in accordance with one embodiment of the present invention.

Referring now to the accompanying drawings wherein like numerals have been used throughout the several views to designate the same or similar parts, there is shown in FIG. 1, a swash plate plunger type pump-motor 1 constructed in accordance with one embodiment of the present invention.

In FIG. 1, designated by reference numeral 3 is a cylindrical casing which is formed with a working oil chamber 5. The casing 3 is closed by an end cap 4. The casing 3 and the end cap 4 are held in axially assembled relationship by suitable clamping means such, for example, as clamping bolts 4a. A rotatable cylinder block 7 has a rotational axis A passing therethrough and is freely rotatably supported at its opposite ends by means of bearings 9 and 11 within the working oil chamber 5 of the casing 3. The cylinder block 7 is formed with a plurality of plunger chambers 13 which are arranged circumferentially equiangularly with respect to the rotational axis A thereof and axially extend parallel to the rotational axis A. A plurality of plungers 15 are each slideably received in the corresponding plunger chamber 13 and axially slideable back and forth in parallel relationship to the rotational axis A of the cylinder block 7 to compress hydraulic working oil in the plunger chambers 13. In this embodiment, the plungers 15 comprise seven plungers in order to equalize the pulsations in the output. One end of each of the plungers 15 serves to compress the hydraulic working oil in each of the plunger chambers 13 to a predetermined value by reciprocating motion of each of the plungers 15. Each plunger 15 is formed at the other end thereof with a plunger head portion 17 larger in diameter than the one end thereof. A swash plate 19 of generally T-shaped cross sectional configuration is arranged at an angle of $\theta$ with respect to the rotational axis A of the cylinder block 7 and has a rotational axis B passing therethrough. The swash plate 19 comprises a circular swash plate portion 21 with front and rear faces 21a and 21b and a cylindrical portion 23 extending forwardly from the front face 21a. A radial bearing 25 is also arranged at an angle of $\theta$ with respect to the rotational axis A of the cylinder block 7. The radial bearing 25 comprises an outer race 25a fixedly mounted on the inner surface of a cylindrical support member 26 nonrotatably mounted on the inner surface of the casing 3 through a key 26a, and a freely rotatable inner race 25b having the cylindrical portion 23 of the swash plate 19 received therein. The outer race 25a and the inner race 25b are retained in position against axial movement by an annular stop 27 mounted in the cylindrical support member 26 and an annular stop 28 mounted in the cylindrical portion 23 of the swash plate 19, respectively. Thus, the swash plate 19 is freely rotatable about the rotational axis B thereof through the radial bearing 25 with respect to the casing 3.

Figure 2:
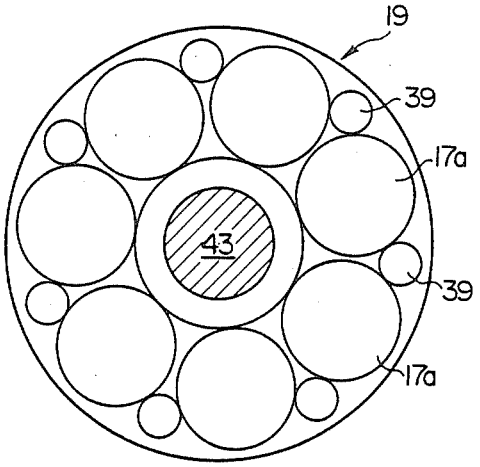
FIG. 2 is a cross sectional view showing the relative positions assumed by plunger head portions of plungers and retainer pins shown in FIG. 1.

The aforementioned plunger head portion 17 of each of the plungers 15 has a front face 17a contacting the rear face 21b of the swash plate portion 21 and a rear face 17b contacting a front face 31a of a plunger retainer 29, to be hereinafter described. The front and rear faces 17a and 17b of the plunger head portion 17 are constituted by conical surfaces each having an angle substantially equal to the angle of inclination $\theta$ of the swash plate 19. The plunger head portion 17 further has an intermediate face 17c between the front and rear faces 17a and 17b which is constituted by a part of a spherical surface. An intersection point 0 of the rotational axis A of the cylinder block 7 and the rotational axis B of the swash plate 19 is located on a plane C on which center axes of the spherical surfaces forming the intermediate face 17c of the plunger head portions 17 are located. The above-noted plunger retainer 29 is of generally T-shaped cross sectional configuration and also arranged at an angle of $\theta$ with respect to the rotational axis A of the cylinder block 7. The generally T-shaped plunger retainer 29 comprises a circular flange portion 31 with the above-noted front face 31a contacted by the rear face 17b of the plunger head portion 17 of the plunger 15, and a cylindrical portion 33 extending forwardly from the front face 31a. The flange portion 31 of the plunger retainer 29 is formed with a plurality of bores 35 through which the plunger head portions 17 extend. The cylindrical portion 23 of the swash plate 19 and the cylindrical portion 33 of the plunger retainer 29 are connected together by a plurality of suitable fastening pins 37 in such a manner that the conical surfaces of the front and rear faces 17a and 17b of the plunger head portion 17 of each of the plunger 15, the rear face 21b of the swash plate 19, and the front face 31a of the plunger retainer 29 are held in line contact relationship with one another. Thus, the plunger retainer 29 effectively prevents the plunger head portions 17 of the plungers 15 from disengaging from the swash plate 19. At the same time, the area of contact is minimized in order to prevent sliding motion associated with friction. It should be noted that, although the plunger head portions 17, the swash plate 19 and the plunger retainer 29 are held in line contact relationship in the aforementioned embodiment of the present invention, they may be held in point contact relationship to further effectively prevent the sliding motion. The swash plate portion 21 of the swash plate 19 and the flange portion 31 of the plunger retainer 29 are connected by a plurality of retainer pins 39 which are located one between two adjacent plunger head portions 17 so that the retainer pins 39 and the intermediate faces of the adjacent plunger head portions 17 are held in point contact relationship with one another as shown in FIG. 2.

Figure 5:
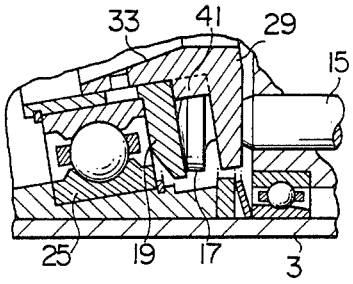
FIG. 5 is a part-sectional view showing a retainer plate of another embodiment of the present invention.
Figure 6:
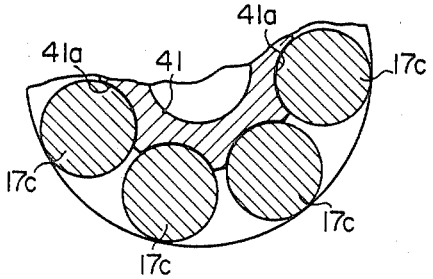
FIG. 6 is a cross sectional view, partly broken away, showing the relative positions assumed by plunger head portions of plungers and the retainer plate shown in FIG. 6.

The retainer pins 39 may be replaced with a unitary annular retainer plate 41 which is shown as a second embodiment of the present invention in FIGS. 5 and 6. The retainer plate 41 is formed with a plurality of curved surfaces 41a corresponding in number to and conforming in configuration to the intermediate faces 17c of the plunger head portions 17. The retainer plate 41 is received through its central opening on the cylindrical portion 33 of the plunger retainer 29.

A rotational shaft 43 is freely rotatably supported through a bearing 45 received in a central bore formed in the end cap 4. The rotational shaft 43 axially extends through the swash plate 19 and the plunger retainer 29 and terminates at an inner end 43a thereof, which is fixedly received in a central bore formed in the cylinder block 7 so that the cylinder block 7 is rotated by rotation of the shaft 43. The shaft 43 serves as an output shaft of an electric motor when the swash plate plunger type pump-motor 1 according to the present invention is employed as a hydraulic pump, and serves as an input shaft of a generator or the like when the swash plate plunger type pump-motor 1 is employed as a hydraulic motor.

Figure 3:
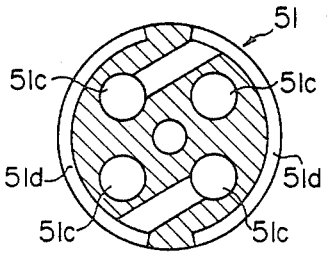
FIG. 3 is a cross sectional view substantially taken along line $Y_1$—$Y_1$ indicated in FIG. 1.
Figure 4:
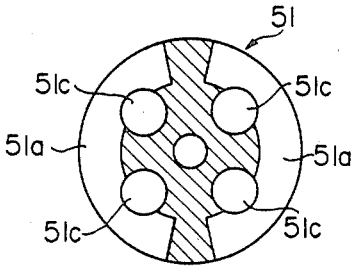
FIG. 4 is a cross sectional view substantially taken along line $Y_2$—$Y_2$ indicated in FIG. 1.
Figure 7:
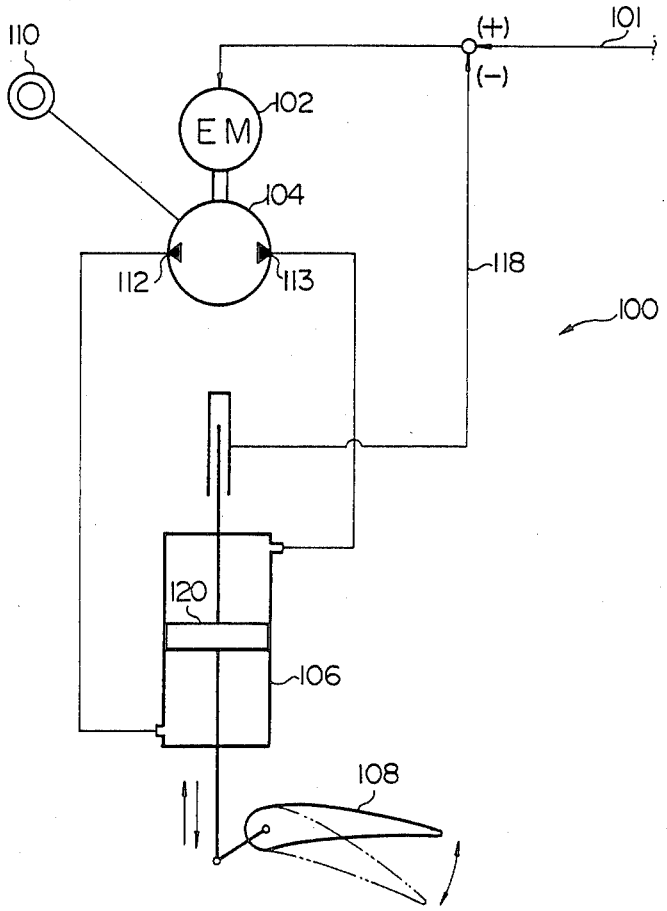
FIG. 7 PRIOR ART
FIG. 7 is a view showing a prior art swash plate plunger pump incorporated in a hydraulic power control system for actuation of a flap of aircraft.

The aforementioned casing 3 is formed with axial ports 47a and 47b which are communicated with actuator means, for example, the actuator 106 as shown in FIG. 7. When one of the axial ports 47a and 47b is used as an inlet port, the other is used as an outlet port. The casing 3 is further formed with a radial port 49 which is communicated at its one end with the working oil chamber 5 and at its the other end with a high-pressure creating source (not shown). A distribution valve 51 is interposed between the cylinder block 7 and the casing 3. The aforementioned cylinder block 7 is rotatable with respect to the distribution valve 51 through the aforementioned bearing 11 fixedly mounted on the distribution valve 51 which is in turn fixedly received in an end bore 53 formed in the casing 3. The distribution valve 51 is formed at its one end with a first set of oil passageways 51*a* and 51*a* (FIG. 4) which extend circumferentially of the valve 51 and are communicated with the plunger chambers 13 through bores 13*a* formed in the cylinder block 7, and at its other end with a second set of oil passageways 51*b* and 51*b* which extend circumferentially of the valve 51 and are communicated with the axial ports 47*a* and 47*b*. The first set of oil passageways 51*a* and 51*a* is communicated with the second set of oil passageways 51*b* and 51*b* by a plurality of axially extending, connecting passageways 51*c*. The distribution valve 51 is further formed at its outer peripheral surface with annular grooves 51*d* and 51*d* (FIG. 3) in order to equalize the pulsations produced therein. The annular grooves 51*d* are communicated with the connecting passageways 51*c* through oblique passageways.

The operation of the swash plate plunger type pump-motor 1 according to the present invention will hereinafter be described.

It is assumed that the swash plate plunger type pump-motor 1 is employed as a hydraulic pump. As the output shaft 43 is driven to rotate about its own axis by an electric motor (not shown), the cylinder block 7 is rotated together with the output shaft 43 and at the same time the swash plate 19 is rotated through the plungers 15 about the rotational axis B thereof. The rotary motion of the swash plate 17 about the rotational axis B, which is arranged at an angle of $\theta$ with respect to the rotational axis A of the cylinder block 7, causes the plungers 15 to reciprocate in the plunger chambers 13. This reciprocating motion of the plungers 15 permits fluid to be admitted in the plunger chambers 13 from one of the ports 47*a* and 47*b* through the distribution valve 51 and also permits high-pressure fluid to be discharged from the plunger chambers 13 through the distribution valve 51 and through the other of the ports 47*a* and 47*b*. During the reciprocating motion of the plungers 15, some of the plungers 15, which are communicated with the inlet port, are subjected to axial or tension force, which pushes them toward the cylinder block 17, due to negative pressure produced in the some of the plunger chambers 13 or high-pressure oil admitted in the working oil chamber 5 through the radial port 49. However, according to the present invention, the plungers 15 are prevented from disengaging from the swash plate 19 by the plunger retainer 29 and thus the pumping operation is performed as desired. At this time, the inner race 25*b* of the radial bearing 25 is also subjected to the axial or tension force through the plungers 15 communicated with the inlet port, plunger retainer 29 and swash plate 19. However, since the radial bearing 25 can take some thrust as well as considerable radial loading, floating phenomenon of the swash plate 19 does not occur, so that the pumping operation is smoothly performed. As noted above, the plungers 15 and the swash plate 19 rotate together through the plungers 15. Namely, they are relatively stationary in relation to each other during rotation. Further, during the rotation, there is only rolling motion among the opposite conical surfaces of the plunger head portion 17 of the plunger 15, the swash plate 19 and the plunger retainer 29, without rolling motion associated with friction. In consequence, because wear which caused by the sliding motion does not occur, a forced or pressure lubrication is not necessary. Furthermore, the plunger head portions 17 of the plungers 15 are engaged by the retainer pins 39 or by the curved surfaces 41*a* of the retainer plate 41. The plunger head portions 17 and the swash plate 19 are therefore maintained in their correct relative positions without sliding motion associated with friction. Hence, even if the output shaft 43 is abruptly frequently rotated in opposite directions, the sliding motion does not occur between the plunger head portions 17 and the swash plate 19, thereby improving mechanical efficiency.

From the foregoing description, it will be seen that, since the sliding motion associated with friction does not occur in the plunger head portion and swash plate, a forced lubrication is not necessary. Accordingly, the swash plate plunger type pump-motor according to the present invention need not to be rotated during stop of the actuator to compensate the oil leakage. Further, because the plunger head portions of the plungers are effectively prevented from disengaging from the swash plate by the plunger retainer, the plungers in stroke of suction is not caused to move in the opposite direction by the negative pressure acting on the plungers. Accordingly, in the present invention, the pumping and suction operation is accurately smoothly performed without being influenced by negative pressure or axial force having adverse and negative effect on the pumping and suction operation.

It should be noted that the foregoing description relates only to preferred embodiments of the present invention and that certain obvious modifications and alternations may be made without departing from the spirit and scope of the present invention.

What is claimed is:

1. A swash plate plunger pump-motor comprising, a casing formed with inlet and outlet ports, a rotatable cylinder block rotatably supported within said casing and formed with a plurality of axially extending chambers, a plurality of plungers axially slideably received in said chambers and each formed with a plunger head portion having a front face, a rear face and an intermediate face between said front and rear faces, a rotatable swash plate rotatably supported through a bearing within said casing and having a rotational axis, a plunger retainer adapted to prevent said plungers from disengaging from said swash plate, the plunger retainer and said swash plate being connected with each other in such a manner that said front faces of said plunger head portions contact said swash plate and that said rear faces of said plunger head portions contact said plunger retainer, and a rotational shaft having a rotational axis passing through said swash plate and through said plunger retainer, the cylinder block being fixedly mounted on said rotational shaft and the rotational axis of said swash plate being inclined at a predetermined angle with respect to said rotational axis of said rotational shaft, in which said intermediate face of said plunger head portion of each of said plungers is constituted by a part of a spherical surface, and in which said swash plate has mounted therein a plurality of retainer pins which are located one between two adjacent plunger head portions in such a manner that said retainer pins and said intermediate faces of said adjacent plunger head portions are engaged in point contact relationship with one another.

2. A swash plate plunger pump-motor comprises, a casing formed with inlet and outlet ports, a rotatable cylinder block rotatably supported within said casing and formed with a plurality of axially extending chambers, a plurality of plungers axially slideably received in said chambers and each formed with a plunger head portion having a front face, a rear face and an intermediate face between said front and rear faces, a rotatable swash plate rotatably supported through a bearing within said casing and having a rotational axis, a plunger retainer adapted to prevent said plungers from disengaging from said swash plate, the plunger retainer and said swash plate being connected with each other in such a manner that said front faces of said plunger head portions contact said swash plate and that said rear faces of said plunger head portions contact said plunger retainer, and a rotational shaft having a rotational axis passing through said swash plate and through said plunger retainer, the cylinder block being fixedly mounted on said rotational shaft and the rotational axis of said swash plate being inclined at a predetermined angle with respect to said rotational axis of said rotational shaft, in which said intermediate face of said plunger head portion of each of said plungers is constituted by a part of a spherical surface, and in which said plunger retainer has received thereon an annular retainer plate which is formed with a plurality of curved surfaces corresponding in number to and conforming in configuration to said intermediate faces of said plunger head portions.

* * * * *